United States Patent [19]

Sato

[11] Patent Number: 4,563,081

[45] Date of Patent: Jan. 7, 1986

[54] APPARATUS FOR CONTROLLING IMAGE FORMING CONDITION

[75] Inventor: Yasushi Sato, Kawasaki, Japan

[73] Assignee: Canon Kabushiki Kaisha, Tokyo, Japan

[21] Appl. No.: 456,380

[22] Filed: Jan. 7, 1983

[30] Foreign Application Priority Data

Jan. 12, 1982 [JP] Japan ..... 57-2314
Jan. 12, 1982 [JP] Japan ..... 57-2315

[51] Int. Cl.[4] ..... G03G 15/00

[52] U.S. Cl. ..... 355/14 CH; 355/3 CH; 355/14 R

[58] Field of Search ..... 355/3 R, 14 CH, 14 C, 355/55, 14 R, 3 CH

[56] References Cited

U.S. PATENT DOCUMENTS 3,788,739 1/1974 Coriale ..... 355/3 X
4,284,344 8/1981 Okamoto et al. ..... 355/14 CH X
4,316,668 2/1982 Miller ..... 355/55

*Primary Examiner*—A. C. Prescott
*Attorney, Agent, or Firm*—Fitzpatrick, Cella, Harper & Scinto

[57] ABSTRACT

An image recording apparatus in which the image recording conditions are detected during continuous recording operation and the image recording means are controlled according to thus detected recording conditions to maintain a constant recording state.

20 Claims, 9 Drawing Figures

APPARATUS FOR CONTROLLING IMAGE FORMING CONDITION

BACKGROUND OF THE INVENTION

1. Field of the Invention

The present invention relates to an image recording apparatus such as a copier or a laser beam printer, and more particularly to such image recording apparatus capable of controlling the image recording conditions.

2. Description of the Prior Art

Image formation in an electrophotographic image recording apparatus such as a copier or a laser beam printer is generally achieved by uniform electrostatic charging of a photosensitive member with corona discharge, imagewise exposure of said photosensitive member to form so-called latent image which is composed of a charge pattern corresponding to an original image pattern, and rendering said latent image visible by depositing developer which is generally called toner.

Such latent image can be formed in various manners, for example by uniform charging of the photosensitive member followed by an exposure to a light image, or by uniform charging of the photosensitive member, then an exposure to a light image simultaneously with an AC charging or a DC charging of a polarity opposite to that of the first charging, and a flush exposure to light over the entire surface.

Also the above-mentioned image development into the visible state may be effected after so-called latent image transfer step, in which the latent image formed on the photosensitive member is transferred onto another latent image bearing member.

In any of the processes mentioned above, the latent image has to be maintained at an appropriate potential in order to match the image development.

Unless the latent image is maintained within a determined range for the image development of a determined condition, there may result an unstable image density and a background staining or fogging.

The maintenance of a constant condition, i.e. a constant potential in the latent image can be hindered for example by (1) the conditions of corona discharge varying according to temperature and humidity, (2) dependence of characteristics of the photosensitive drum on temperature and humidity, and (3) fluctuation among different photosensitive drums.

In order to avoid the influence of the above-mentioned factors, there is already proposed an electrophotographic recording apparatus in which the potential of a dark or light area on a photosensitive member is detected by a potential sensor and the high voltage for generating corona discharge is so controlled as to bring the detected potential toward a desired potential, and such apparatus is already found effective to a certain extent.

In the conventional potential controlling method, however, the image quality may not be maintained at the initial level during a continuous recording operation even though the initial image quality may be satisfactory, since the potential drifts away from the initial value.

For example, as a general tendency, the potential of a photosensitive member may become gradually higher or lower after repeated corona discharges even if the conditions of corona charging are maintained same, and such tendency is particularly marked when the image recording is conducted after the apparatus is put out of operation for a prolonged period.

Such tendency, if caused by the photosensitive member itself, for example by the charging hysteresis thereof, may be resolved by suitable selection of materials and manufacturing process of the photosensitive member, but the developmental work directed to such purpose will not only be time-consuming work but also be expensive, thus inevitably leading to the high cost of the photosensitive member.

Also a continuously stable image quality cannot be expected merely from the potential control before the start of recording operation, in case the temperature and humidify affect also to the potential.

The drawbacks of the conventional methods are well illustrated in FIGS. 1A and 1B, showing the change of dark potential in time, in case the latent image is to be formed in an exposed area.

FIG. 1A shows a case in which the dark potential gradually increases in the course of a continuous recording operation.

In such case the dark potential eventually exceeds an upper limit potential $V_{ul}$ in the course of a continuous recording operation, even if the initial dark potential $V_{di}$ is adjusted to an optimum value.

Also FIG. 1B shows a case in which the potential becomes gradually lower and eventually becomes lower than a lower limit potential $V_{ll}$.

Said upper and lower limit potentials $V_{ul}$, $V_{ll}$ are determined by the matching of the developing device and the image potential. As an example, in case the light potential is a smaller negative potential than the dark potential and the developer is so-called two-component developer composed of carrier particles such as iron powder and of toner particules made of carbon and resinous material, $V_{ul}$ corresponds to a limit potential not causing carrier deposition, and $V_{ll}$ corresponds to a limit potential not causing toner deposition in the backgroup area.

Consequently a satisfactory image quality can only be obtained, in a continuous recording operation, up to a time $t_1$ in case of FIG. 1A or up to a time $t_2$ in case of FIG. 1B.

In order to avoid such drawback the potential control is indispensable during the course of a continuous recording operation.

In case of intermittent image forming operations, the potential control may be effected for each frame of image to continuously maintain an appropriate potential, but such method inevitably reduces the throughput of the apparatus.

It is becoming more and more necessary to obtain a stable image quality without affecting the through-put of the recording apparatus, since a higher process speed is required for recent electrophotographic copiers and computer output terminals.

The high voltage for generating corona discharge may be regulated according to the tendency of potential drift of the photosensitive member if such tendency is constantly predictable, but in practice such tendency varies depending on the manufacturing lot of the photosensitive members and on the ambient conditions.

SUMMARY OF THE INVENTION

In consideration of the foregoing, an object of the present invention is to provide an image recording apparatus capable of continuously stable image recording without deteriorating the throughput of the apparatus.

Another object of the present invention is to provide an image recording apparatus capable of detecting the image recording conditions of a recording member in the course of a continuous recording operation and controlling the image recording means according to a determined image recording condition.

Still another object of the present invention is to provide an image recording apparatus capable of detecting that the image recording condition does not meet a determined state and controlling the image recording means in such a manner that the image recording approaches to said determined state.

The foregoing and still other objects of the present invention will become fully apparent from the following description.

DETAILED DESCRIPTION OF THE PREFERRED EMBODIMENT

Now the present invention will be explained in detail by embodiments thereof shown in the attached drawings.

Figure 2:
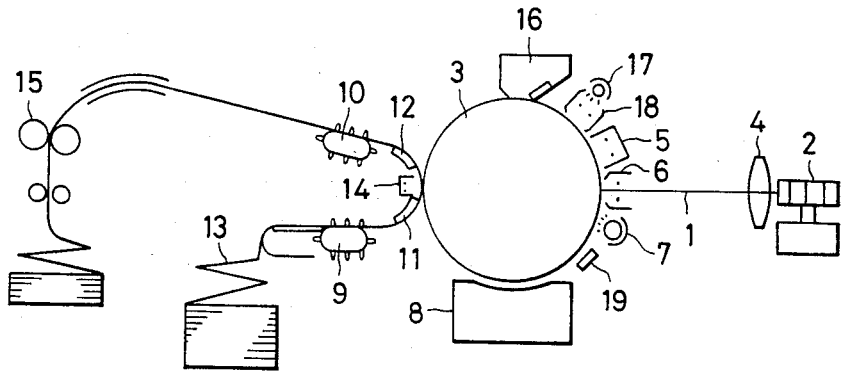
FIG. 2 is a schematic view of a laser beam printer embodying the present invention.

FIG. 2 schematically shows a laser beam printer embodying the present invention, wherein a laser beam 1, emitted from an unrepresented laser unit, is modulated by input signals supplied to an unrepresented modulater, then is put into scanning motion by a rotary polygonal mirror 2 and is focused onto a photosensitive member 3 through an imaging lens 4, thereby exposing said photosensitive member 3 to a light image.

Naturally the above-mentioned laser beam may be replaced, for achieving the same purpose, by other suitable means such as a cathode ray tube, a plasma display device or a light-emitting diode (LED) array.

As already known, a photosensitive member 3 is essentially composed of a conductive substrate, a photoconductive layer and an insulating layer, and is at first uniformly charged by a primary corona charger 5, then is subjected to an imagewise exposure similtaneously with an AC corona discharge from a secondary corona charger 6, and is finally exposed uniformly to a flush exposure lamp 7, thereby forming an electrostatic latent image corresponding to the original light image on said photosensitive member.

Said electrostatic latent image is developed into a toner image by a developing station 8.

Said toner image may be formed either in a light area which has been exposed to light, or in a dark area which has not been exposed to light.

In the present embodiment it is assumed that the image formation is conducted according to the former method.

The toner image thus obtained is transferred, by means of an electric field generated by a transfer corona charger 14, onto a fan-fold sheet 13 transported by tractors 9, 10 along transportation guides 11, 12, and the toner image thus transferred is fixed on said fan-fold sheet 13 by a fixing station 15 and ejected from the apparatus.

On the other hand, the photosensitive member 3 having passed the image transfer station is cleaned in a cleaning station 16 to eliminate the remaining developer, and is then subjected to uniform exposure by a lamp 17 and to charge elimination by a DC corona charger 18, whereby the remaining charge is eliminated and the photosensitive member is prepared for the next imaging cycle.

Prior to the start of a recording operation, the photosensitive member 3 performs a pre-rotation step for standardizing the image recording condition, during which a dark area and a light area are formed by a laser beam and the corresponding potentials are measured by a potential sensor 19. The voltages initially supplied to the primary and secondary corona chargers are determined according to thus measured potentials.

Figure 3:
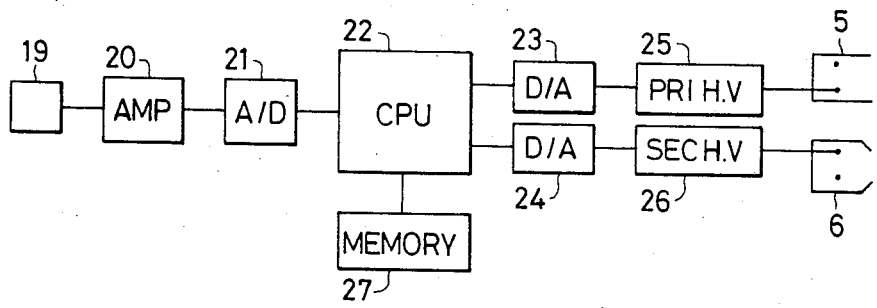
FIG. 3 is a block diagram showing a control unit for said laser beam printer.

FIG. 3 is a block diagram of a system for controlling the high voltages for generating corona discharges, in which the potential of the photosensitive member measured by the potential sensor 19 is amplified by an amplifier 20, then is converted into digital signals by an A/D converter 21 and is supplied to a central processing unit (CPU) 22 composed essentially of a known one-chip microcomputer incorporating read-only memories, random access memories etc.

The CPU 22 compares the potential of the light or dark area on the photosensitive member 3 with a reference value stored in a memory 27, calculates a primary high voltage to be supplied to the primary corona charger 5 and a secondary high voltage to be supplied to the secondary corona charger 6 for obtaining an appropriate surface potential according to a determined algorithm and supplies corresponding signals to digital-to-analog (D/A) converters 23, 24.

In this manner the primary and secondary high voltages for attaining an appropriate potential on the photosensitive member are supplied, through D/A coverters 23, 24, to primary and secondary high voltage sources 25, 26, whereby the primary and secondary corona chargers 5, 6 are given thus corrected high voltages.

The surface potential formed on the photosensitive member by thus corrected high voltages is again measured by the potential sensor 19, and the recording operation is commenced only after the confirmation that the surface potential has reached an appropriate value.

Figure 4:
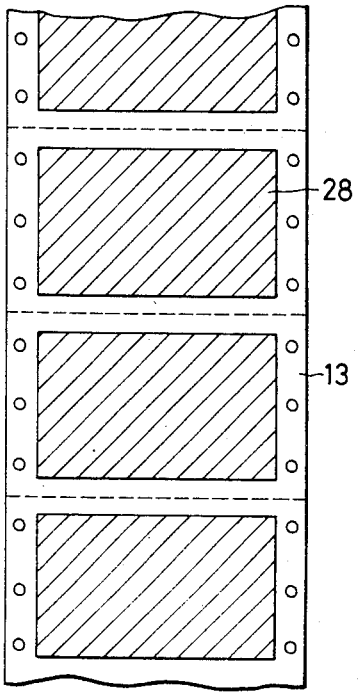
FIG. 4 is a schematic view showing image areas and non-image areas of a fan-fold sheet.

In a recording apparatus for printing on a fan-fold sheet as shown in the present embodiment, the recording operation is usually interrupted at the folds in order to prevent unsatisfactory image recording caused by defective image transfer due to the presence of perforations at such folds. FIG. 4 shows such recording format, in which the image is formed only in the hatched areas. In this manner there exist blank areas not containing image patterns between frames, even in a continuous recording operation.

In the present embodiment the high voltage sources are controlled according to the surface potential of the photosensitive member detected in such blank areas between frames, thereby maintaining a constant latent image potential on the photosensitive member 3.

More detailedly, again referring to FIG. 3, the potential of the photosensitive member 3 measured by the potential sensor during the continuous recording operation is latched at intervals corresponding to the blank areas between frames and is supplied to the CPU 22. Said intervals can be determined either by a mechanical pulse generator such as a rotary encoder generating clock pulses corresponding to the rotation of the photosensitive member 3, or by signals generated by a controller releasing the optical image information.

Also in case of using the start of a frame of information to be recorded as a standard position for the potential measurement, the potential in said blank area between frames can be measured by effecting the measurement with a delay corresponding to a time required by the rotation of the photosensitive member from the position of image exposure to the position of the potential sensor.

In the present embodiment in which the toner image is formed in an area exposed to the laser beam, said blank area between frames constitutes a background representing a dark potential. The dark potential thus measured in the blank area between frames is stored in the memory 27.

The potentials in the blank areas between frames are stored in succession in the above-described manner, and the CPU 22 utilizes the average value of last five measurements for the comparison, in order to avoid local fluctuations or noises on the photosensitive drum. Said average value of the potentials in the blank areas is compared with a reference potential, and, if a deviation is found, the CPU 22 generates such a high voltage as to realize an appropriate surface potential. In the present embodiment the primary high voltage source 25 alone is controlled for this purpose.

Figure 5:
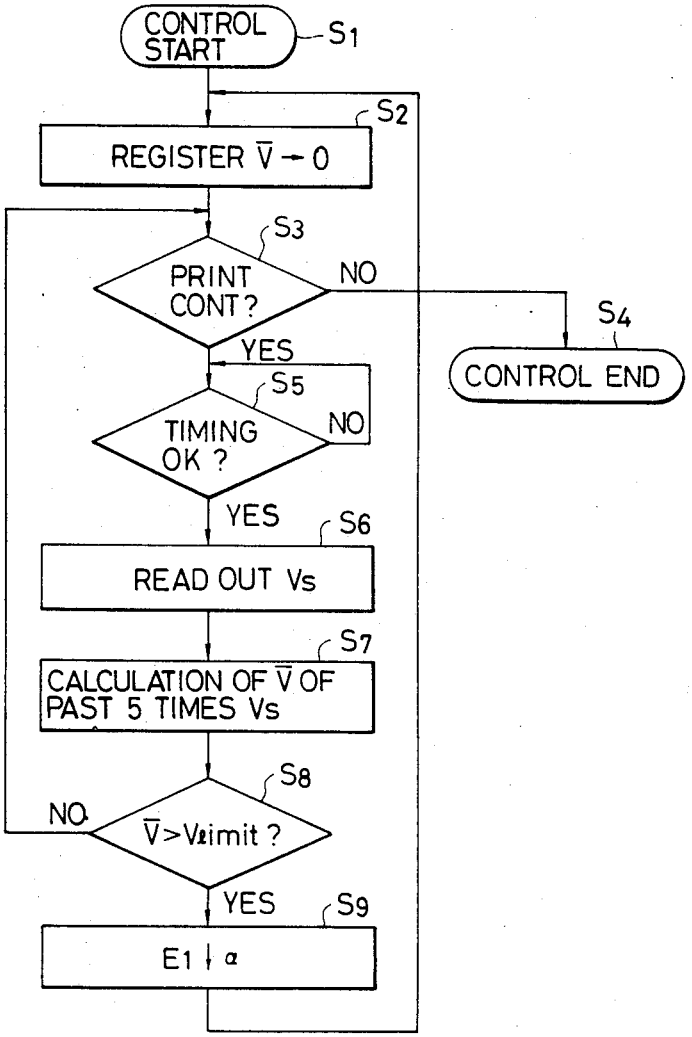
FIGS. 5 to 7 are flow charts showing an embodiment of the present invention.

Now reference is made to flow charts shown in FIG. 5, for explaining the algorithm employed in the present invention, for the purpose of surface potential measurements at intervals corresponding to the blank areas between frames.

At first, a step S1 initiates the control procedure for the CPU 22, and a step S2 clears a register for storing the average value $\overline{V}$ of the surface potentials.

In a succeeding step S3 identifies whether the recording operation is in progress. If not, a step S4 terminates the potential control.

If the recording operation is in progress, a step S5 identifies whether the timing corresponds to blank areas between frames, and, if affirmative, a step S6 is executed to read the surface potential Vs of the photosensitive member 3 and store the measured potential in a determined area of the memory 27. Said memory 27 is provided with five areas for storing the measured values of the surface potential Vs, and always stores five latest data by suitable address control. A succeeding step S7 calculates the average value $\overline{V}$ of the potentials in five blank areas between frames and stores said avarage value in the register. Said average value $\overline{V}$ is compared with a admissible limit potential $V_{limit}$, which represents the admissible limit of potential increase $V_{shift}$ not causing stains by the deposition of carrier particles or toner particles at the image development, and is equal to the sum of the initially selected potential $V_{di}$ plus said potential increase $V_{shift}$.

The measurement of the surface potential is continued until the average value $\overline{V}$ of the latest five surface potentials Vs reaches the admissible limit potential $V_{limit}$ in a step S8, whereupon a step S9 is executed to reduce the primary high voltage $E_1$ by $\alpha$ volts. Consequently the surface potential comes closer to the initially selected potential $V_{di}$. Thus the value of $\alpha$ is determined by the influence of change in the primary high voltage on the surface potential. It is to be noted that the surface potential need not necessarily adjusted to the initially selected potential $V_{di}$ by the reduction of the high voltage by $\alpha$ volts, but the value of $\alpha$ may be so selected as to bring the surface potential within the admissible potential range $V_{shift}$.

FIG. 5 shows a process of measuring the background potential in synchronization with the blank areas between frames, but such process may result in a drawback because of delays in measurements depending on the potential sensor or detecting system employed. In order to prevent such drawback it may be possible to select the potential sensors and detecting systems of a same response time or to determine the timing of measurement for each system, but such solution is disadvantageous in terms of cost and labor required. Such drawback can however be avoided by an algorithm shown in FIG. 6.

At first a step S1 initiates the control procedure for the CPU 22, and a step S2 clears a register for storing the average value $\overline{V}$ of the surface potentials.

Thereafter a step S3 clears a timer T provided in a timer area of the memory 27, and a succeeding step S4 identifies whether the recording operation is in progress. If not, a step S5 terminates the potential control.

If the recording operation is in progress, a step S6 is executed to repeatedly measure the surface potential Vs of the photosensitive member 3 at an interval T1. Said interval T1 is preferably selected sufficiently shorter than the interval with which the blank areas between frames pass the potential sensor 19. The measured potential Vs is stored in the memory 27 in a step S7.

A succeeding step S8 discriminates whether the surface potential Vs measured at the interval T1 has passed a time T2 longer than the interval between frames, and, if so, a step S9 selects the maximum value Vms of the surface potential during said time T2 and stores said maximum value. As already explained in the foregoing, the address control for the memory 27 is conduced in such a manner as to only store five latest data.

In case said time T2 has not elapsed, the program returns to the step S4 after waiting for the time T1.

The extraction of the maximum value Vms at the step S9 signifies that the background potential between frames is measured during the time T2. Upon measurement of the maximum value Vms of the background potential between frames or within a frame, a step S10 is executed to calculate the average value $\overline{V}$ of the preceding plural potentials, i.e. five potentials Vms in the present embodiment, which are stored in the memory 27.

Said calculation is conducted to minimize the error resulting from noises or local fluctuations of the photosensitive member, and prevents a possibility of an abnormal potential control in case an appropriate potential is erroneously identified as inappropriate.

The average value $\overline{V}$ thus calculated is compared, in a step S11, with an admissible limit potential $V_{limit}$.

Said limit potential $V_{limit}$ is equal to the sum of the initially selected potential $V_{di}$ and a potential increase $V_{shift}$ admissible for providing a satisfactory image quality.

In case said average value $\overline{V}$ exceeds the limit potential $V_{limit}$, a step S12 is executed to reduce the primary high voltage E1 to the primary corona charger 5 by $\alpha$ volts, whereby the surface potential becomes closer to the initially selected potential $V_{di}$. Thus the value of $\alpha$ is determined by the influence of change in the primary high voltage on the surface potential. It is to be noted that the surface potential need not necessarily adjusted to the initially selected potential $V_{di}$ by the reduction of the high voltage by $\alpha$ volts, but the value of $\alpha$ may be so selected as to bring the surface potential within the admissible potential range $V_{shift}$. Namely the explanation on $\alpha$ made in relation to FIG. 5 applies also to this case. In this manner it is rendered possible to maintain the surface potential of the photosensitive member within a determined range and to stably continue the satisfactory recording operation.

Figure 6:
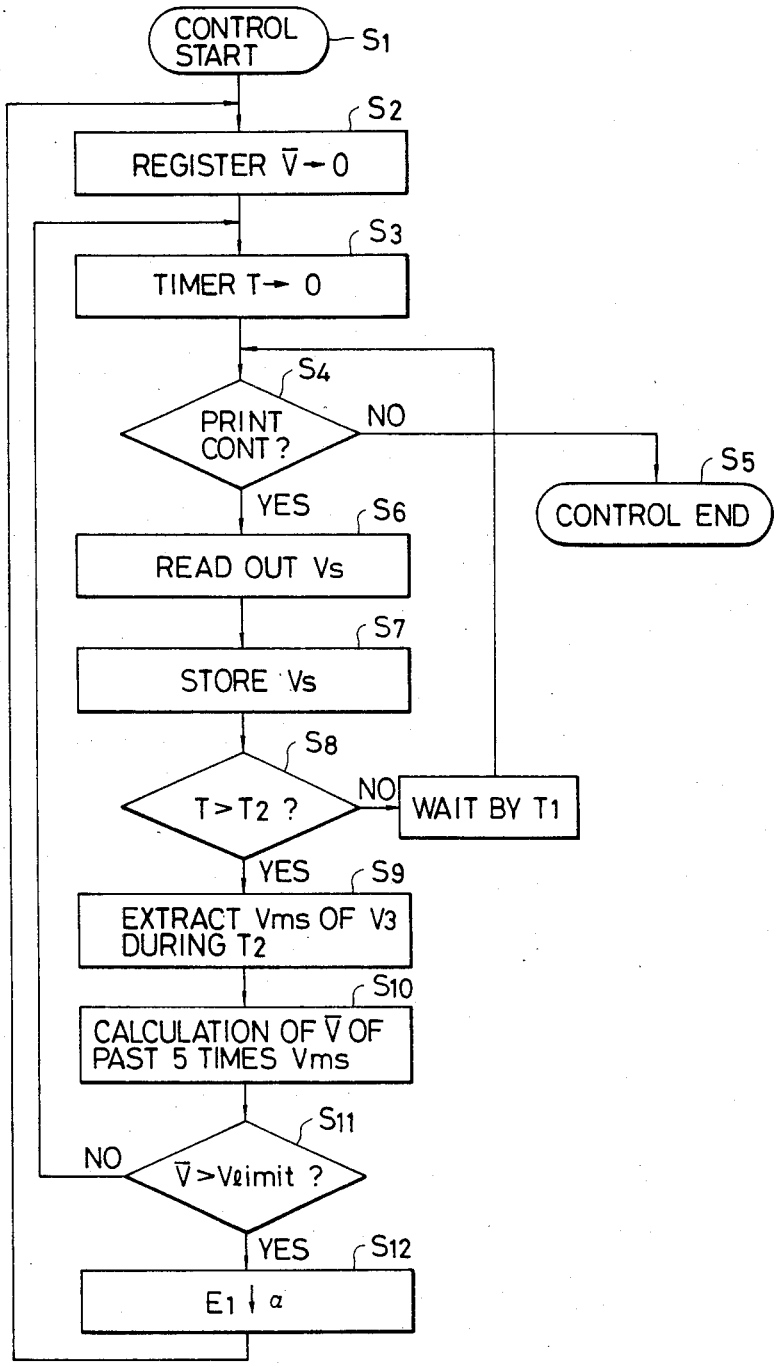

In the foregoing embodiments shown in FIGS. 5 and 6, the primary corona charger 5 is not regulated until the average value $\overline{V}$ reaches the limit value $V_{limit}$, but it is also possible to stepwise increase the control signal to the primary corona charger 5 before said average value $\overline{V}$ reaches the limit value $V_{limit}$.

Figure 7:
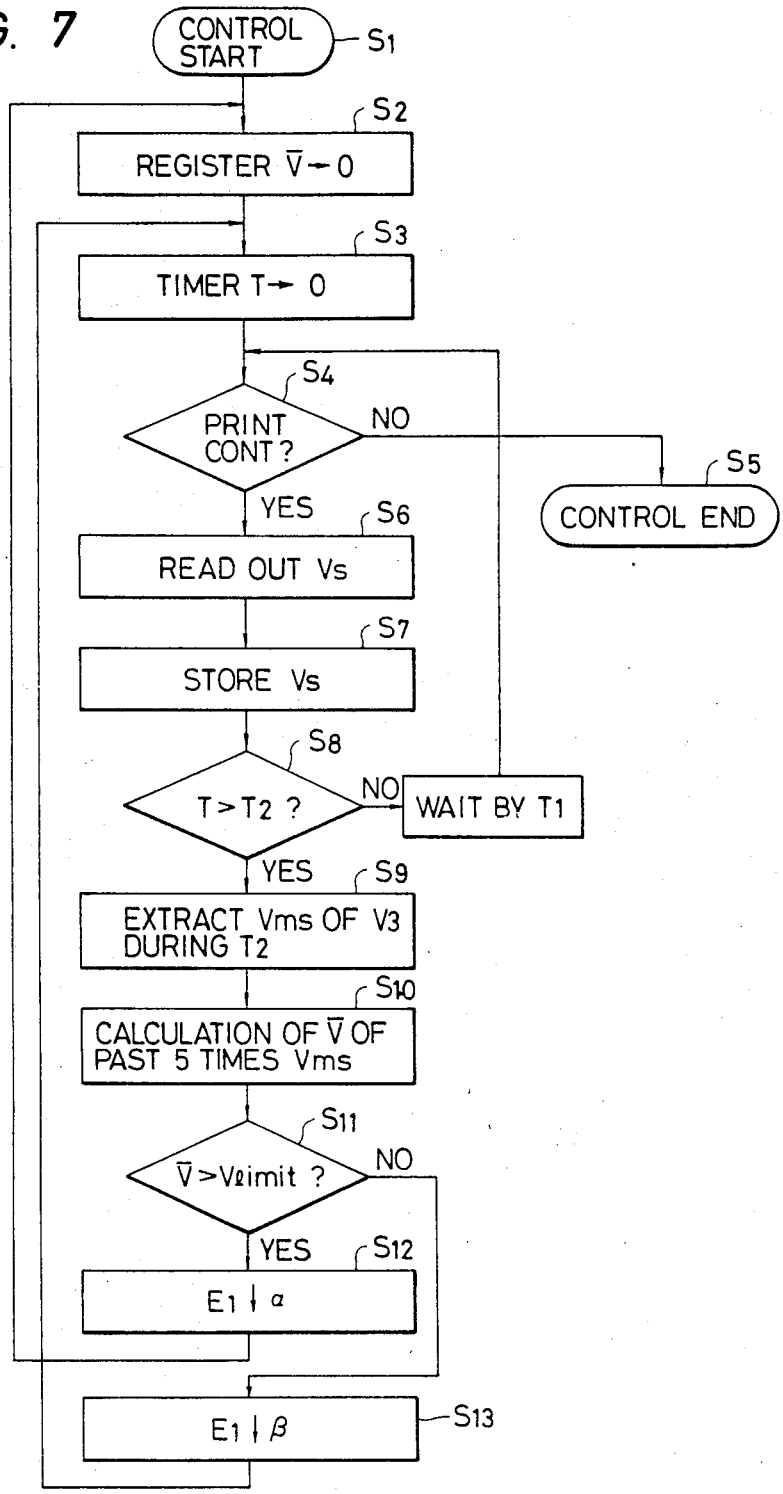

An algorithm for such control process is shown in FIG. 7.

In FIG. 7, at first a step S1 initiates the control procedure for the CPU 22, and a step S2 clears a register for storing the average value $\overline{V}$ of the surface potentials. Thereafter a step S3 clears a timer T provided in a timer area of the memory 27, and a succeeding step S4 identifies whether the recording operation is in progress. If not, a step S5 terminates the potential control.

If the recording process is in progress, a step S6 is executed to repeatedly measure the surface potential Vs of the photosensitive member 3 at an interval T1. Said interval T1 is preferably selected sufficiently shorter than the interval with which the blank areas between frames as shown in FIG. 5 pass the potential sensor 19. The measured potential Vs is stored in the memory 27 in a step S7.

A succeeding step S8 discriminates whether a time T2, longer than the interval between frames, has elapsed since the measurement of the surface potential Vs conducted at the interval T1, and, if so, a step S9 selects the maximum value Vms of the surface potentials measured during the period T2, and stores said maximum value in a determined area in the memory 27. As already explained in the foregoing, the address control for the memory 27 is conducted in such a manner as to only store five latest data.

In case said time T2 has not elapsed, the program returns to the step S4 after waiting for the time T1.

The extraction of the maximum value Vms at the step S9 signifies that the background potential between frames is measured during the time T2. Upon measurement of the maximum value Vms of the background potential between frames or within a frame, a step S10 is executed to calculate the average value $\overline{V}$ of the preceding plural potentials, i.e. five potential Vms in the present embodiment, which are stored in the memory 27.

Said calculation is conducted to minimize the error resulting from noises or local fluctuations of the photosensitive member, and prevents a possibility of an abnormal potential control in case an appropriate potential is erroenously identified as inappropriate.

The average value $\overline{V}$ thus calculated is compared, in a step S11, with an admissible limit potential $V_{limit}$.

Said limit potential $V_{limit}$ is equal to the sum of the initially selected potential $V_{di}$ and a potential increase $V_{shift}$ admissible for obtaining a satisfactory image quality.

In case said average value $\overline{V}$ exceeds the limit potential $V_{limit}$, a step S12 is executed to reduce the primary high voltage E1 to the primary corona charger 5 by $\alpha$ volts, whereby the surface potential becomes closer to the initially selected potential $V_{di}$. Thus the value of $\alpha$ is determined by the influence of change in the primary high voltage on the surface potential. It is to be noted that the surface potential need not necessarily adjusted to the initially selected potential $V_{di}$ by the reduction of the high voltage by $\alpha$ volts, but the value of $\alpha$ may be so selected as to bring the surface potential within the admissible potential range $V_{shift}$.

Figure 1A:
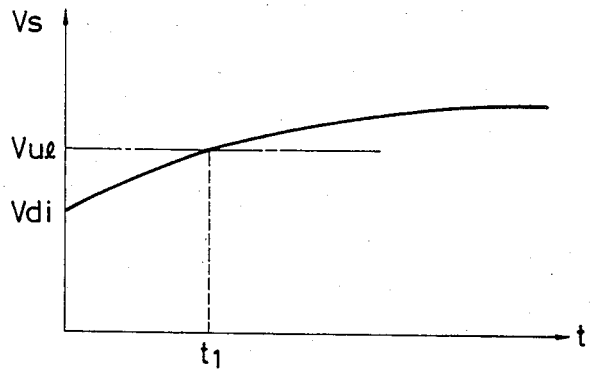
FIGS. 1A and 1B are charts showing time-dependent changes of the surface potential of a photosensitive member in the course of a continuous recording operation.
Figure 1B:
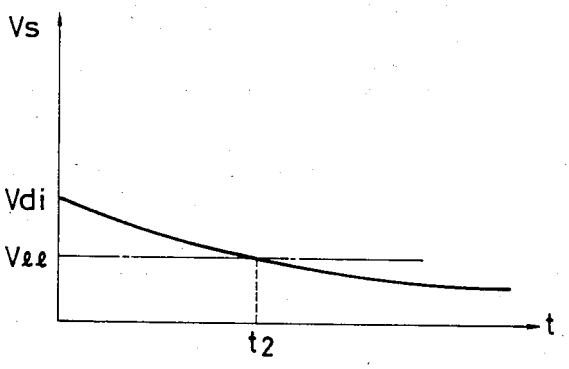

In case the average value $\overline{V}$ reaches the limit value $V_{limit}$, the program returns to the step S2 after executing the step S12. On the other hand, in case the average value $\overline{V}$ does not reach the limit value $V_{limit}$, a step S13 is executed to elevate the primary high voltage E1 to the primary corona charger 5 by $\beta$ volts. The value of $\beta$ should be so selected as to cover the drawback explained in relation to FIG. 1B, and may be selected equal to $T2\times(V_{di}-V_{li})/t_2$. This amount can be empirically determined, and $\beta$ may be selected somewhat larger than said amount, with a certain safety margin. In a case shown in FIG. 1A, the surface potential does not significantly exceed the value $V_{limit}$ even if the primary high voltage E1 is elevated.

After the raise of the primary high voltage $E_1$ by $\beta$ volts, the program returns to the step S3 to repeat the same procedure.

In this manner it is rendered possible to stably maintain the surface potential of the photosensitive member within a determined range and to continue satisfactory recording operation.

Although the present invention has been explained by embodiments in which the image information constitutes light areas while the background constitutes dark areas, the present invention is also applicable to a case in which the background is exposed to constitute a light area.

The present invention is applicable not only to a laser beam printer as explained in the foregoing but also to other various copying apparatus for reproducing an original image.

In the foregoing explanation, it is assumed that the background potential is positive so that the maximum potential assumes a positive large value. However, in case the background potential is negative while the image potential is positive, the maximum potential assumes a negative large value. Same applies to the admissible limit potential $V_{limit}$.

In the foregoing embodiments there is employed a method for detecting the surface potential, but the present invention is not limited to such method but may employ, for example, a method of detecting the image density after image development with a photosensor.

Also instead of controlling the primary corona charger as shown in the foregoing embodiments, it is possible also to control the secondary corona charger or the developing bias voltage. In an apparatus for reproducing an original image, it is furthermore possible to control an original exposure lamp. It is furthermore possible to detect the image density of the original document with a photosensor and to accordingly control the exposure lamp, chargers and/or developing bias voltage.

Such potential control between frames in a continuous recording operation allows to obtain images with a constant density and without background fog, even if a prolonged continuous recording operation.

Figure 8:
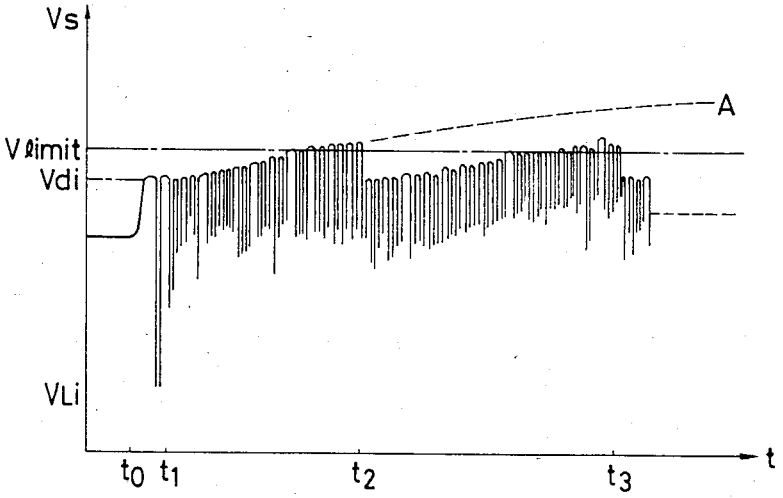
FIG. 8 is a chart showing the time-dependent change of the surface potential controlled according to the present invention.

The effect of such potential control is shown by the plotting of surface potential in FIG. 8. In FIG. 8, the photosensitive member starts rotation at $t_0$, and the initial potential is determined during a pre-rotation step until $t_1$, thereby realizing potentials $V_{li}$ and $V_{di}$ respectively in the light and dark areas. A conventional recording operation in such state results in smear or a deficient image density due to the shift of the background potential in the dark area beyond the limit potential as represented by a dotted line A, but the aforementioned control corrects the primary high voltage at $t_2$ and $t_3$ thereby providing a stable potential on the photosensitive member.

In FIG. 8 it is to be noted that the light potential during recording operation does not reach V, but this is merely due to insufficient resolving power of the sensor and insufficient response of the recorder.

As explained in the foregoing, the present invention allows to obtain image recordings with a constant density and without background fog even in a prolonged continuous recording operation through a process of setting the potential of a photosensitive member at a desired initial value prior to the start of recording operation, selecting a particular potential from potentials measured during said continuous recording operation, and controlling the corona voltage in such a manner as to bring the potential of the photosensitive member toward the initial potential in case said selected potential deviates from the initial potential in excess of a determined range.

Although the present invention has been explained by particular embodiments thereof, the present invention is by no means limited to such embodiments but is subject to various modifications within the scope and spirit disclosed in the appended claims.

What I claim is:

1. An image recording apparatus comprising:
image recording means for forming spaced images on a continuous recording member;
detecting means for repeatedly detecting an image recording condition associated with an area between the images on said recording member during a continuous image recording operation; and
control means for controlling said image recording means in accordance with an output signal from said detecting means, said control means being adapted, when said image recording condition detected by said detecting means falls outside of a predetermined range, to control said image recording means so as to bring said image recording condition into said predetermined range.

2. An image recording apparatus according to claim 1, wherein said control means applies an output signal to said image controlling means and is adapted to stepwise control the control output signal to said image recording means in response to said image recording condition.

3. An image recording apparatus according to claim 1 or 2, wherein said image recording means comprises a primary corona charger, and said control means is adapted to control said primary corona charger.

4. An image recording apparatus according to claim 1, wherein said image recording means forms an electrostatic latent image on a photosensitive member, develops said latent image, and then transfers the developed image to said recording member, and wherein said image recording condition is the surface potential on said recording member.

5. An image recording apparatus according to claim 2, wherein said control means is adapted to stepwise elevate said control output signal in case said image recording condition is within said determined range and to stepwise lower said control output signal in case said image recording condition is outside of said determined range.

6. An image recording apparatus according to claim 1, wherein said control means comprises analog-to-digital converting means for converting the output signal of said detecting means from analog form into digital form.

7. An image recording apparatus according to claim 1, wherein said control means comprises digital-to-analog converting means for converting the control output signal to said image recording means from digital form into analog form.

8. An image recording apparatus comprising:
image recording means for image recording on a recording member;
detecting means for repeatedly detecting image recording conditions of said image recording means in an image recording area on said recording member during a continuous recording operation; and
control means adapted to control said image recording means in accordance with a particular image recording condition selected from said image recording conditions repeatedly detected by said detecting means with a predetermined time, wherein said detecting means detects the image recording condition associated with an area in which an image has been recorded on said recording member and another area, between the images, within said predetermined time.

9. An image recording apparatus according to claim 8, wherein said particular image recording condition is a maximum or minimum value of image recording conditions detected during said predetermined time.

10. An image recording apparatus according to claim 8 or 9, wherein said control means is adapted to calculate an average value of plural particular image recording conditions measured in the past and to control said image recording means in response to said average value.

11. An image recording apparatus according to claim 8, wherein the detecting time of said image recording condition by said detecting means is selected shorter than an interval with which blank areas between image frames on said recording member pass said detecting means.

12. An image recording apparatus according to claim 8, wherein said determined time is selected longer than a period required by an image area on said recording member to pass said detecting means.

13. An image recording apparatus according to claim 8, 9 or 10, wherein said particular image recording condition is an image recording condition corresponding to a non-image area on said recording member.

14. An image recording apparatus according to claim 8, wherein said control means is adapted to standardize said image recording condition prior to the start of image recording operation.

15. An image recording apparatus comprising:
image recording means for image recording on a recording member;

detecting means for detecting an image recording condition of said image recording means; and control means for controlling said image recording means in accordance with an output signal from said detecting means, said control means being adapted, where the image recording condition detected by said detecting means falls outside of a predetermined range, to control a control output for said image recording means so as to bring said image recording condition into the predetermined range, and further so as to vary the control output for said image recording means by a given amount until the detected image recording condition falls outside of the predetermined range.

16. An image recording apparatus comprising:

image recording means for image recording on a recording member;

detecting means for repeatedly detecting image recording conditions of said image recording means during a continuous image recording operation;

storage means for storing data according to the image recording conditions obtained by the repeated detecting operation of said detecting means; and control means for controlling said image recording means based on the combination of the data stored in said storage means and new data obtained by the repeated detecting operation of said detecting means.

17. An image recording apparatus according to claim 16 wherein said detecting means detects a surface condition of a non-image area between image areas on said recording member.

18. An image recording apparatus according to claim 17 wherein said storage means stores a plurality of data, and an arithmetic operation for the plural data in said storage means is performed to control said image recording means in accordance with the result obtained by the arithmetic operation.

19. An image recording apparatus according to claim 18 wherein the arithmetic operation is to obtain an average value of the plural data.

20. An image recording apparatus according to claim 1 wherein said recording member is a fanfold sheet.

* * * * *

UNITED STATES PATENT AND TRADEMARK OFFICE

CERTIFICATE OF CORRECTION

PATENT NO. : 4,563,081

DATED : January 7, 1986

INVENTOR(S) : YASUSHI SATO

It is certified that error appears in the above-identified patent and that said Letters Patent is hereby corrected as shown below:

COLUMN 2

Line 14, "humidify" should read --humidity--.
Line 35, "particules" should read --particles--.

COLUMN 5

Line 44, "In a succeeding" should read --A succeeding--.
Line 57, "avarage" should read --average--.
Line 59, "a admissible" should read --an admissible--.

COLUMN 6

Line 6, "necessarily adjusted" should read --necessarily be adjusted--
Line 44, "conduced" should read --conducted--.

COLUMN 7

Line 8, "necessarily adjusted" should read --necessarily be adjusted--.
Line 66, "erroenously" should read --erroneously--.

COLUMN 8

Line 12, "necessarily adjusted" should read --necessarily be adjusted--.

UNITED STATES PATENT AND TRADEMARK OFFICE

CERTIFICATE OF CORRECTION

PATENT NO. : 4,563,081

DATED : January 7, 1986

INVENTOR(S) : YASUSHI SATO

It is certified that error appears in the above-identified patent and that said Letters Patent is hereby corrected as shown below:

COLUMN 9

Line 3, "if" should read --in--

Signed and Sealed this

*Thirtieth* Day of *September 1986*

[SEAL]

*Attest:*

DONALD J. QUIGG

*Attesting Officer*

*Commissioner of Patents and Trademarks*